US005568124A

United States Patent [19]

Joyce et al.

[11] Patent Number: 5,568,124

[45] Date of Patent: Oct. 22, 1996

[54] METHOD TO DETECT PENETRATION OF A SURFACE AND APPARATUS IMPLEMENTING SAME

[75] Inventors: Richard J. Joyce, Thousand Oaks; Allan R. Kramer, Simi Valley, both of Calif.

[73] Assignee: Hughes Aircraft Company, Los Angeles, Calif.

[21] Appl. No.: 64,680

[22] Filed: May 20, 1993

[51] Int. Cl.[6] ..... G08B 13/00

[52] U.S. Cl. ..... 340/550; 109/29; 109/42

[58] Field of Search ..... 340/550, 544; 109/29, 31, 38, 42, 34; 385/13

[56] References Cited

U.S. PATENT DOCUMENTS

| | | | |
|---|---|---|---|
| 3,594,770 | 7/1971 | Ham et al. | 340/550 |
| 3,763,795 | 10/1973 | Wetz, Jr. | 340/550 X |
| 4,367,460 | 1/1983 | Hodara | 340/550 |
| 4,791,410 | 12/1988 | Larsson | 340/550 |
| 4,922,228 | 5/1990 | Jacobson | 340/550 |
| 4,972,175 | 11/1990 | MacPherson | 340/550 |
| 5,258,741 | 11/1993 | Fuller | 340/546 X |

FOREIGN PATENT DOCUMENTS

| | | | |
|---|---|---|---|
| 2434436 | 4/1980 | France | 340/550 |

*Primary Examiner*—Thomas Mullen

*Attorney, Agent, or Firm*—V. D. Duraiswwamy; W. K. Denson-Low

[57] ABSTRACT

Apparatus and method for detecting unauthorized disturbance of a protected surface, includes a substrate adapted to conformably encase and adhere to the surface that is to be protected. A plurality of layers, each comprising a plurality of frangible conduits is embedded in the substrate and randomly overlays a majority of the protected surface. Each of the conduits has its ends protruding from the substrate to permit a monitor to be coupled thereto for monitoring the integrity of the continuity of each conduits, and for switching from a first state to a second state whenever the continuity of any of the conduits is broken. A warning alarm is coupled to the monitor for displaying the state of the monitor.

2 Claims, 1 Drawing Sheet

METHOD TO DETECT PENETRATION OF A SURFACE AND APPARATUS IMPLEMENTING SAME

BACKGROUND OF THE INVENTION

1. Field of the Invention

This invention relates in general to security devices, and, more particularly, to a method and an apparatus for detecting unauthorized disturbance of a protected surface.

2. Description of the Related Art

Maintaining the security of circuitry and devices from unauthorized tampering is a difficult problem in today's industrial environment. The purpose of such tampering might be to reverse-engineer, sabotage, or access the contents of a container or tap into circuitry.

Currently, any product which requires that its contents remain secure from unauthorized penetration has a limited number of security devices available for its protection. Examples of such sensitive devices are TEMPEST electronic devices and secured data communication links carrying such sensitive data as financial transactions or personal communications.

In general, the known existing state of the art appears in the form of a product having insulated wires woven into a screen mesh. The woven wires are monitored for a break which in turn sounds an alarm. However, in this product the weave pattern is highly repetitive due to its automated manufacturing process, and due to structural and cost considerations, only a small number of active sensing wires are woven into the overall mesh. With this configuration of both a highly repetitive pattern and sparse sensing wires, it is fairly easy to overcome and penetrate the device in an undetected manner.

Such existing protection devices are also complicated, bulky, contain less sensing elements, are of dubious reliability and therefore are easily circumvented.

SUMMARY OF THE INVENTION

The present invention provides a method and an apparatus that will significantly enhance the ability to detect the unauthorized penetration or disturbance of a secured perimeter or surface, such as that of an enclosed container, a cabinet of electronic equipment, a printed circuit board or integrated chip, or even a shipping or cargo container.

The present invention also provides a method and an apparatus for detecting unauthorized disturbance of a protected area. The apparatus is easy to manufacture, requires little maintenance and is both economical and easy to use.

Generally, the present invention is embodied in a method and a product that contains a highly random and dense distribution of conduits layered into sheets of varying thicknesses which are then formed into conformal skins and monitored to protect the outer surfaces of a controlled space, container or surface from penetration.

The conduits can be wires, fiber optic cables, tubes or other means of conveyance of a media which, when cut, broken or punctured causes a change in some measurable parameter. The change can be detected and displayed as a sign of a disruption or penetration of the protected surface or container.

In other words, by randomly laying down a series of conduits, such as fiber optic cables or wires, on a two dimensional surface and building up layers of such conduits in a third dimension over the surface that is to be protected or monitored, the present invention is able to implement a perimeter protection scheme somewhat analogous to a single trip wire, but with a protection density which is thousands of times greater. Because of the density and randomness of the conduit placement over a majority of the protected surface area, the likelihood of someone defeating this barrier is significantly reduced.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENT

With reference being made to the Figures, a preferred embodiment of the present invention will now be described in an apparatus for detecting unauthorized disturbance of a protected surface.

Figure 1:
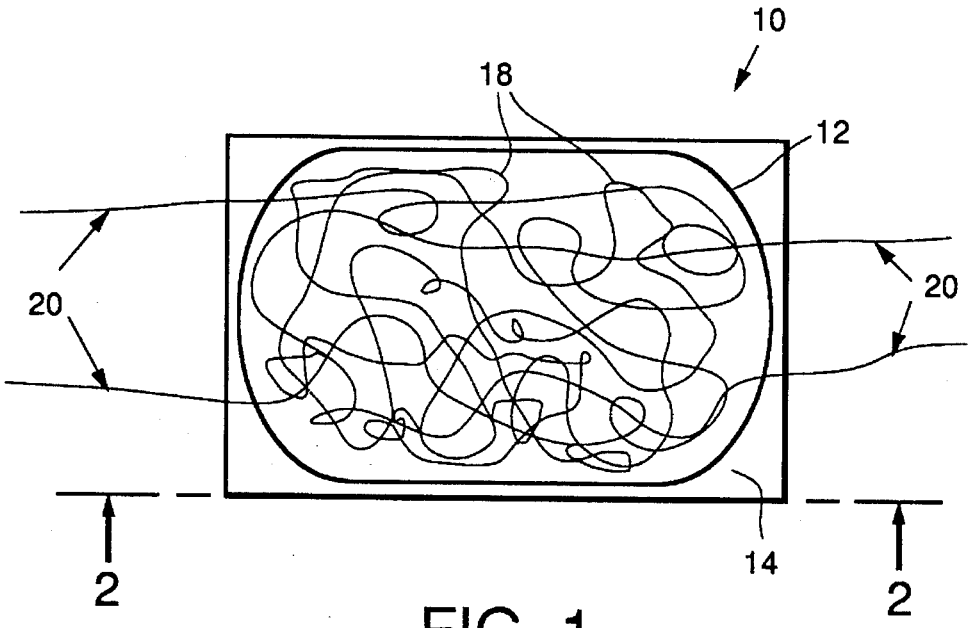
FIG. 1 is a plan view showing the present invention embodied to protect a circuit board.
Figure 2:
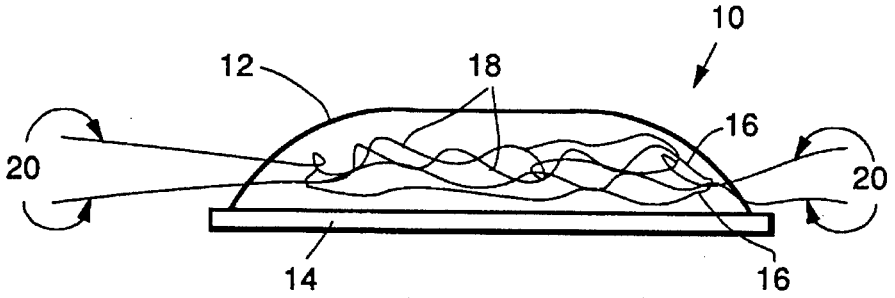
FIG. 2 is a cross sectional view taken along line 2—2 of FIG. 1.

The apparatus in a preferred form is shown in plan view in FIG. 1 and in cross section in FIG. 2. It includes a substrate 12 adapted to conformably encase and adhere to the surface 14 that is to be protected or monitored. The substrate may be either flexible or rigid depending upon the particulars of the surface and or device that is to be protected. One such preferred substrate 12 would be an epoxy compound. The epoxy compound could be applied in a soft state to surface 14 to be protected or monitored, and allowed to harden in place once the wires or conduits described below are overlaid on the surface. The epoxy compound is also preferably opaque to avoid giving any indication as to the nature of the surface being covered or as to the exact placement of the wires or conduits described below. Thus, an intruder will be unable to see and avoid the sensing wires if a penetration of the compound is attempted.

The substrate may also comprise a material that remains soft or flexible so as to permit it to better encase the surface to be protected. Acceptable soft or flexible substrates would include, as non-limiting examples, RTV (Room Temperature Vulcanizing) materials, silicone rubbers and polyimides.

In another embodiment, a flexible surface such as a mesh or a fabric on which the wires are layered and which is then applied as a conformal skin to cover the surface to be protected is used. Once the wires and flexible surface are conformed to the protected surface, the epoxy compound in its softened state can be applied and allowed to harden to form a final covering that not only adheres to the protected surface, but renders it impossible to examine the protected surface without disrupting the monitoring system described below.

The flexible surface described in this alternate embodiment can be permeable to the epoxy compound to enable it to adhere directly to the protected surface, or it can be impermeable to the epoxy compound to protect the protected surface from direct contact with the epoxy compound. Both types of flexible surfaces have advantages for different kinds of surfaces for which protection is sought.

Figure 3:
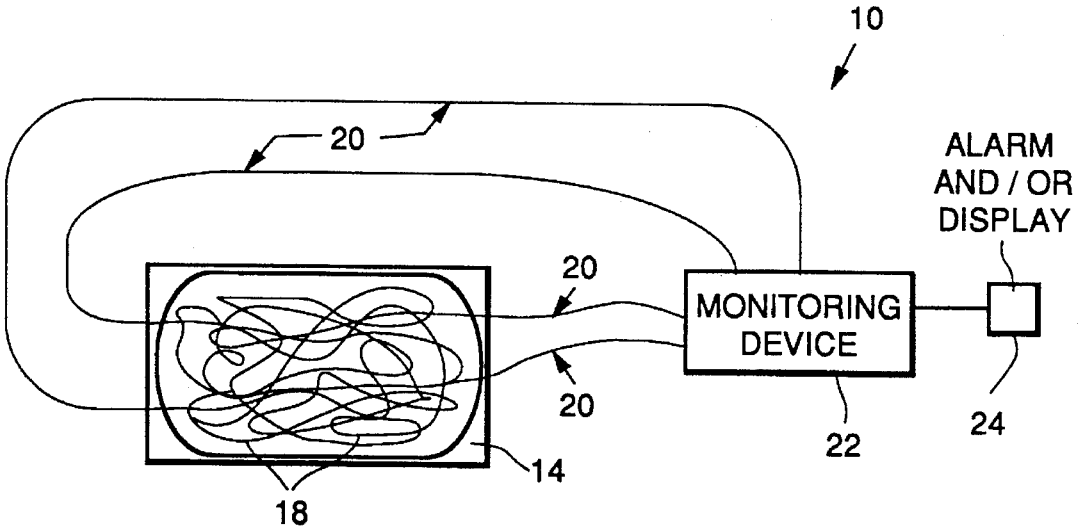
FIG. 3 is an idealized block diagram showing the present invention embodied to protect a circuit board.

Overlaid over surface 14 is a plurality of layers 16, each including a plurality of frangible conduits 18 randomly overlaying a majority of the protected surface 14 and adapted to be embedded in substrate 12. Each of the plurality of conduits 18 has at least one, and preferably both of its ends 20 protruding from substrate 12 to allow a monitoring device 22 to monitor the continuity status of each of the embedded conduits as shown in FIG. 3.

Preferably conduits 18 would include electrically conductive wires, fiber optic cables, or even tubes containing a liquid such as a dye that seeps out of the tube if the tube were broken and discolor the substrate or interacts chemically with the substrate to produce a visual warning of tampering, or even a gas containing an odor which may be readily detected by the human nose.

The monitoring device 22 which monitors conduit continuity integrity must be chosen to operatively couple with the type of conduits used. For example, if the conduits are electrically conductive wires, and the substrate is selected to be nonconductive, one such preferred monitoring device 22 is a circuit checker, such as an ohmmeter, coupled to the ends of the conduits protruding from the substrate. The monitoring device 22 monitors the integrity of the continuity of each of the conduits embedded in the substrate either on a continuous basis or by polling either sequentially or randomly through each of the wires. Monitoring device 22 switches from a first state to a second state whenever it detects that the continuity of any of the monitored wires has been broken.

Another alternative would be to use a substrate that is conductive, and embed therein electrically conductive wires having a frangible insulative covering. In this embodiment, the monitoring device 22 is coupled between the conductive substrate and the wires, and switches from its first state to its second state whenever conduction is detected between any of the wires and the substrate.

A warning alarm circuit 24 is connected to the monitoring device 22 to signal any detected tampering. Preferred display mechanisms include visual and/or audio warnings such as lights or bells that sound to warn of an attempted security breach whenever the monitor 22 switches its states. Other warning systems include a microprocessor operating under a security program that logs the detected disturbance and takes appropriate action such as shutting down the protected piece of equipment, informing an operator or the like warning.

The present invention is embodied in a process or method for detecting unauthorized disturbance of a protected surface.

At least a portion of the surface to be protected is overlaid with randomly distributed frangible conduits such as with electrically conductive wires or fiber optic cables. Preferably a major portion of the surface to be protected is overlaid with wire, as the larger the portion of the protected surface that is overlaid by conduits, the better the detection of an unauthorized disturbance of the surface, as it becomes more likely that any attempted penetration will disturb the overlaid conduits if they cover more of the surface than not. Likewise, the higher the density of the overlain conduits, the harder the final assembly will be to penetrate undetected, as the more likely a disturbance will affect one of the conduits.

Once the conduits are placed over the surface, the surface is encased in a substrate adapted to adhere to the surface and embed the frangible conduits therein. The ends of frangible conduits should be left extending from the substrate to allow connection with a monitor as discussed above and below.

The continuity of each of the conduits is monitored by checking each of the extending ends of the conduits either on a continuous basis or by polling either sequentially or randomly through each of the wires.

The monitor is in a first state indicating that the continuity of each of the monitored conduits is unbroken. The monitor 22 switches to a second state whenever the continuity of any of the monitored conduits is broken.

A working model embodying the present invention and built in accord with the disclosure presented herein was fabricated using a very fine enamel coated wire that was randomly layered on a supporting sheet to assist holding the wires in place on the surface that was to be protected.

Many separate circuits or wire loops were randomly placed over a majority of the surface that was to be protected. Once a density of wires was achieved wherein a the surface area to be monitored was overlaid by a wire, the whole arrangement was coated with an epoxy for rigidity, opacity and resistance to attack. This basic arrangement is shown in FIG. 1 with a cross section shown in FIG. 2.

As described above, the simplest form of penetration detection of this particular implementation monitors the continuity of each completed circuit. An embellishment would detect shorts between circuits created during a penetration attempt such as one using a highly corrosive acid or laser ablation.

Additionally, one could use a conductive epoxy so that the likelihood of shorting a wire to ground through the epoxy is increased. A further refinement would be to use multiple signal levels of random interrogations of circuit paths to prevent the sophisticated intruder from determining which circuits are connected and then attempting to jumper or by-pass the active circuits.

The present configuration was fabricated and then attached to a clear plastic box. While monitoring the four separate circuits, an attempt was made to drill through the protected area with a hand drill using a small diameter drill bit. Results showed that all four circuits were simultaneously opened, demonstrating the effectiveness of both random distribution of the wires over the surface to be protected and the importance of the density of wires used to overlay the surface to be protected. As would be expected, the higher the density of wires used for a given surface area, the greater the sensitivity of the invention to penetration attempts.

In manufacturing embodiments of the present invention, a computer controlled plotting table may be used to pay out the wire over the surface that is to be protected and to control the randomness and density of the wire coverage.

The invention described above is, of course, susceptible to many variations, modifications and changes, all of which are within the skill of the art. It should be understood that all such variations, modifications and changes are within the spirit and scope of the invention and of the appended claims. Similarly, it will be understood that Applicant intends to cover and claim all changes, modifications and variations of the example of the preferred embodiment of the invention herein disclosed for the purpose of illustration which do not constitute departures from the spirit and scope of the present invention.

What is claimed is:

1. Apparatus for detecting unauthorized disturbance of a protected surface, comprising:

a substrate adapted to conformably encase and adhere to the protected surface, wherein said substrate is comprised of a conductive compound;

a plurality of frangible conduit means embedded in said substrate and randomly overlaying at least a first portion of the protected surface, each of said plurality of frangible conduit means having its ends protruding from said substrate, wherein said plurality of frangible conduit means embedded in said substrate comprises a plurality of electrically conductive wires having a frangible insulative covering thereon;

monitor means, coupled to said protruding ends of said plurality of frangible conduit means, for monitoring the integrity of the continuity of each of said plurality of frangible conduit means and for switching from a first state to a second state whenever the continuity of any of said plurality of frangible conduit means is broken, wherein said monitor means is further coupled to said substrate and switches from said first state to said second state whenever conduction is detected between any of said plurality of frangible conduit means and said substrate, and display means coupled to said monitor means for displaying said first and second states of said monitor means.

2. Apparatus for detecting unauthorized disturbance of a protected surface, comprising:

a substrate adapted to conformably encase and adhere to the protected surface wherein said substrate is comprised of a conductive compound;

at least one frangible conduit means embedded in said substrate and randomly overlaying at least a first portion of the protected surface and having, for each of said at least one frangible conduit means, at least one end protruding therefrom, wherein said at least one frangible conduit means embedded in said substrate comprises a plurality of electrically conductive wires having a frangible insulative covering thereon;

monitor means, coupled to each of said protruding ends of said at least one frangible conduit means, for monitoring the integrity of the continuity of said at least one conduit means and for switching from a first state to a second state whenever the continuity of any of said conduit means is broken, wherein said monitor means is further coupled to said substrate and switches from said first state to said second state whenever conduction is detected between any of said plurality of conduit means and said substrate; and display means coupled to said monitor means for displaying said first and second states of said monitor means.

* * * * *